US011566539B2

(12) United States Patent
Tashima et al.

(10) Patent No.: US 11,566,539 B2
(45) Date of Patent: Jan. 31, 2023

(54) GAS TURBINE AND GAS TURBINE MANUFACTURING METHOD

(71) Applicant: TOSHIBA ENERGY SYSTEMS & SOLUTIONS CORPORATION, Kawasaki (JP)

(72) Inventors: Tsuguhisa Tashima, Yokohama Kanagawa (JP); Shogo Iwai, Tokyo (JP); Takahiro Ono, Tokyo (JP); Norikazu Takagi, Kawasaki Kanagawa (JP)

(73) Assignee: TOSHIBA ENERGY SYSTEMS & SOLUTIONS CORPORATION, Kawasaki (JP)

( * ) Notice: Subject to any disclaimer, the term of this patent is extended or adjusted under 35 U.S.C. 154(b) by 0 days.

(21) Appl. No.: 17/343,211

(22) Filed: Jun. 9, 2021

(65) Prior Publication Data

US 2022/0065131 A1 Mar. 3, 2022

(30) Foreign Application Priority Data

Aug. 28, 2020 (JP) ..... JP2020-144407

(51) Int. Cl.
*F01D 25/16* (2006.01)
*F01D 25/26* (2006.01)
*F01D 25/30* (2006.01)

(52) U.S. Cl.
CPC ..... *F01D 25/162* (2013.01); *F01D 25/26* (2013.01); *F01D 25/30* (2013.01); *F05D 2230/644* (2013.01)

(58) Field of Classification Search
CPC ..... F01D 3/04; F01D 11/001; F01D 5/085; F05D 2220/31; F05D 2260/15;
(Continued)

(56) References Cited

U.S. PATENT DOCUMENTS

2010/0034641 A1* 2/2010 Ikeda ..... F01D 25/26 415/177
2014/0023478 A1* 1/2014 Maeda ..... F01D 3/04 415/111
(Continued)

FOREIGN PATENT DOCUMENTS

CN 109790756 A * 5/2019 ..... F01D 25/24
DE 10 2014 224 419 A1 6/2016
(Continued)

OTHER PUBLICATIONS

English Translation JP-6746780-B2 (Year: 2020).*
English Translation CN-109790756-A (Year: 2019).*

*Primary Examiner* — Shafiq Mian
(74) *Attorney, Agent, or Firm* — Foley & Lardner LLP

(57) ABSTRACT

According to an embodiment, a gas turbine includes: a casing; a rotor shaft penetrating through the casing; a plurality of turbine stages which are in the casing and are arranged along an axial direction of the rotor shaft and through which a working fluid passes; two bearings disposed on outer sides of the casing in terms of the axial direction and supporting the rotor shaft in a rotatable manner; and a plurality of outlet pipes through which the working fluid having finished work in the turbine stages is discharged. The outlet pipes are provided in an upper half and a lower half of the casing.

8 Claims, 10 Drawing Sheets

(58) Field of Classification Search
CPC ..... F05D 2240/55; F05D 2260/221; F05D 2220/30; F05D 2240/24
See application file for complete search history.

(56) References Cited

U.S. PATENT DOCUMENTS

| | | | | |
|---|---|---|---|---|
| 2016/0069570 | A1* | 3/2016 | Twardochleb | F23R 3/16 29/889 |
| 2018/0202320 | A1 | 7/2018 | Mitsui et al. | |
| 2019/0226360 | A1 | 7/2019 | Santais | |
| 2021/0180470 | A1* | 6/2021 | Kuwamura | F01D 25/30 |

FOREIGN PATENT DOCUMENTS

| | | | | |
|---|---|---|---|---|
| JP | 2019120152 | A * | 7/2019 | F01D 25/30 |
| JP | 6746780 | B2 * | 8/2020 | F01D 25/24 |
| WO | WO-2017/068615 | A1 | 4/2017 | |

* cited by examiner

GAS TURBINE AND GAS TURBINE MANUFACTURING METHOD

CROSS-REFERENCE TO RELATED APPLICATION

This application is based upon and claims the benefit of priority from Japanese Patent Application No. 2020-144407 filed on Aug. 28, 2020, the entire content of which is incorporated herein by reference.

FIELD

Embodiments of the present invention relate to a gas turbine and a gas turbine manufacturing method.

BACKGROUND

In turbines such as gas turbines and steam turbines, a high-temperature and high-pressure fluid is supplied through an inlet and expands in the turbine to give rotational energy to the turbine, and after doing work, flows out through an outlet pipe.

Turbines have recently increased in capacity and pressure, but increasing the capacity of a turbine as well as increasing turbine plant performance leads to a size increase of the turbine, often resulting in a larger distance between bearings.

In recent years, a whirl phenomenon such as steam whirl or gas whirl has been experienced with the increases in capacity and pressure of turbines. The whirl phenomenon is self-excited vibration of a rotor shaft caused by working fluid force generated in a working fluid sealing part. That is, this is a phenomenon of primary-mode vibration of shafting caused by excitation force that is generated when a working fluid leaks at turbine rotor blade tips, excitation force that is generated when the pressure of labyrinth seal parts between turbine stator blades and a rotor shaft varies, or other such force. The whirl phenomenon easily occurs with a load increase to be a factor to hinder the normal operation of a turbine plant.

Since the whirl vibration is the primary-mode vibration of the shafting as described above, it is desired that the distance between the bearings be reduced as much as possible.

DETAILED DESCRIPTION

An object of embodiments of the present invention is to reduce the distance between bearings while enhancing turbine performance.

According to an aspect of the present invention, there is provided a gas turbine comprising: a casing; a rotor shaft penetrating through the casing; a plurality of turbine stages which are disposed in the casing and are arranged along an axial direction of the rotor shaft and through which a working fluid passes; two bearings disposed on axially both outer sides of the casing and supporting the rotor shaft in a rotatable manner; and a plurality of outlet pipes through which the working fluid having finished work in the turbine stages is discharged as exhaust gas, wherein the outlet pipes are provided in an upper half of the casing and a lower half of the casing.

Gas turbines and gas turbine manufacturing methods according to embodiments of the present invention will be hereinafter described with reference to the drawings. Here, identical or similar parts are denoted by common reference signs and redundant description thereof will be omitted.

First Embodiment

Figure 1:
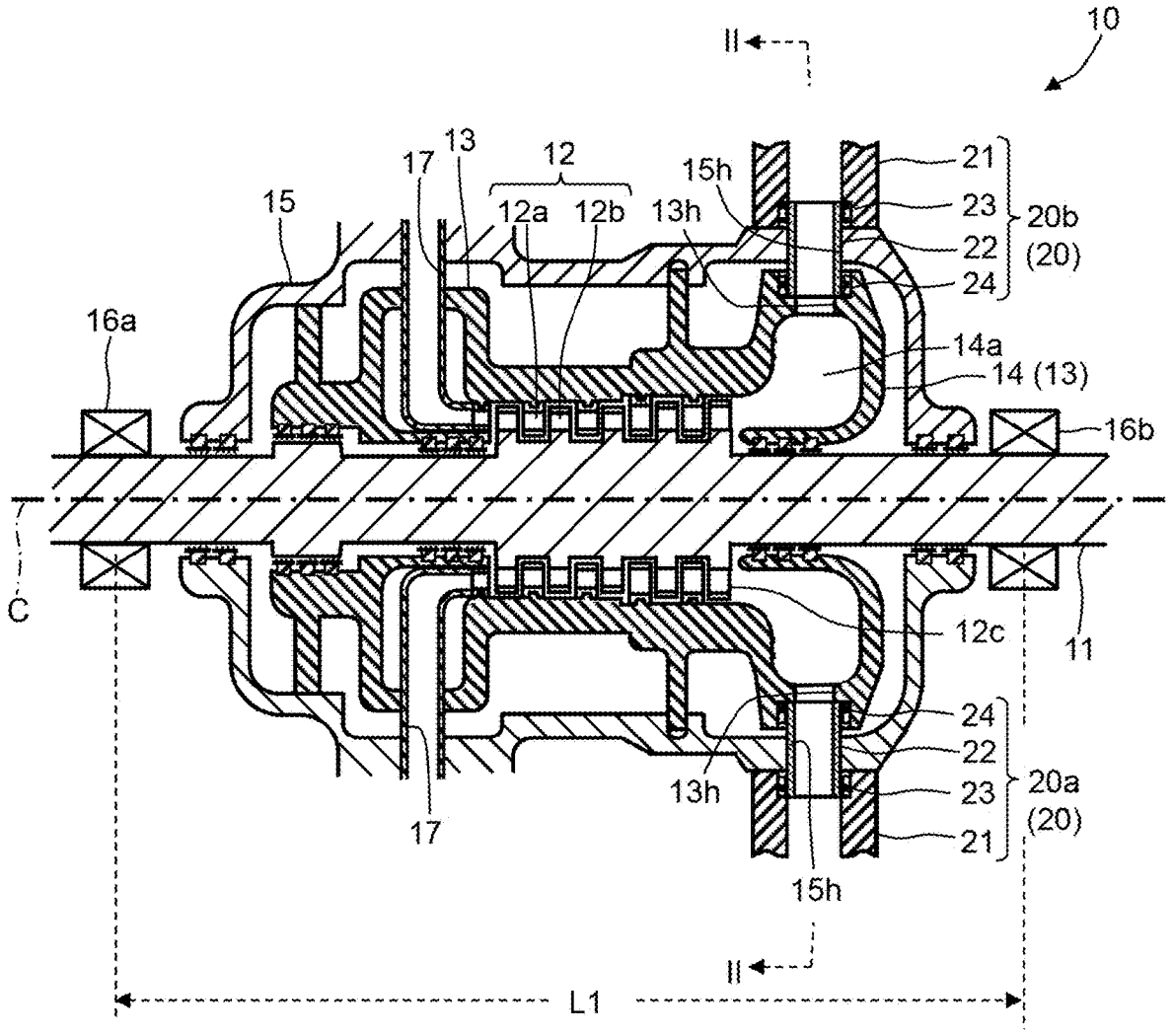
FIG. 1 is a sectional view illustrating the configuration of a gas turbine according to a first embodiment, taken along the turbine axis, taken along arrow I-I in FIG. 2.
Figure 2:
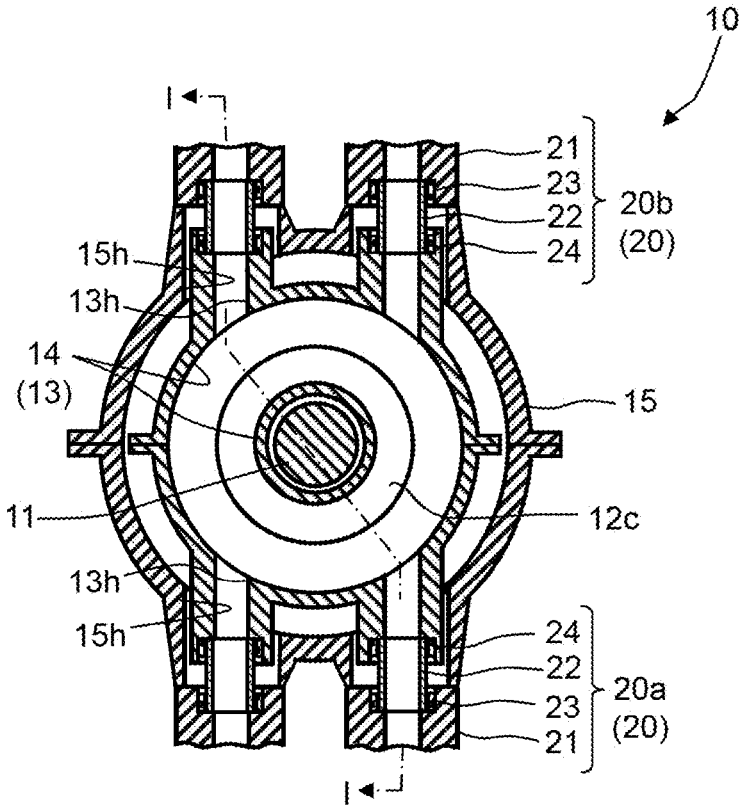
FIG. 2 is a sectional view illustrating the configuration of the gas turbine according to the first embodiment, taken along arrow II-II in FIG. 1.

FIG. 1 is a sectional view illustrating the configuration of a gas turbine 10 according to a first embodiment, taken along the turbine axis C, taken along arrow I-I in FIG. 2, and FIG. 2 is its sectional view taken along arrow II-II in FIG. 1. Hereinafter, a direction parallel to the turbine axis C will be called an axial direction and a direction from the turbine axis C toward an outer side in terms of a direction perpendicular to the axial direction will be called a radial direction.

The gas turbine 10 is an axial flow turbine and includes: a casing, that is, an inner casing 13 and an outer casing 15 surrounding the inner casing 13; a rotor shaft 11; a plurality of turbine stages 12 through which a working fluid passes; two bearings, that is, a front bearing **16*a* and a rear bearing 16*b*; transition pieces 17 which guide the working fluid to the turbine stages 12; and a plurality of outlet pipes 20 through which the working fluid having finished work in the turbine stages 12** (hereinafter, referred to as exhaust gas) is discharged.

As illustrated in FIG. 2, the casing, that is, the inner casing 13 and the outer casing 15 are each divided into a lower half and an upper half, and the lower half and the upper half are coupled with not-illustrated bolts and nuts at their flanges. However, the inner casing 13 and the outer casing 15 each may have an integrated shape having an annular cross section, instead of being divided into the lower half and the upper half. Further, the casing may have a single structure instead of having the inner casing 13 and the outer casing 15.

In the following, such case that the casing has the inner casing 13 and the outer casing 15 and is divided into the lower half and the upper half is exemplified.

The rotor shaft 11 penetrates through the inner casing 13 and the outer casing 15 in the axial direction. The two bearings support axial two sides of the rotor shaft 11 in a rotatable manner. On axially outer sides of the outer casing 15, the front bearing 16*a* among the two bearings is disposed on a working fluid upstream side and the other rear bearing 16*b* is disposed on a working fluid downstream side.

Here, the distance between the axially middle position of the front bearing 16*a* and the axially middle position of the rear bearing 16*b* illustrated in FIG. 1 will be referred to as the distance between the bearings. In FIG. 1, the distance between the bearings is L1.

The turbine stages 12 are arranged with axial intervals therebetween and serve as annular flow paths where the working fluid guided by the transition pieces 17 flows to work.

The turbine stages 12 each have a plurality of stator blades 12*a* and a plurality of rotor blades 12*b* each of which is adjacent to and downstream of each of the stator blades 12*a*. The stator blades 12*a* are attached to the inner casing 13 and arranged throughout the whole circumferences along the circumferential direction to form a stator blade cascade. The rotor blades 12*b* are attached to the rotor shaft 11 and arranged throughout the whole circumferences along the circumferential direction to form a rotor blade cascade.

The most downstream part of the inner casing 13, that is, an outlet part to which the working fluid flows out from a final-stage rotor blade cascade 12*c* of the most downstream turbine stage 12 is an exhaust chamber wall 14 to form an exhaust chamber 14*a*. Note that the individual rotor blades of the final-stage rotor blade cascade 12*c* are not illustrated in FIG. 2.

Through the outlet pipes 20, the working fluid which has finished work in the turbine stages 12 and is present in the inner casing 13 is discharged as the exhaust gas. The outlet pipes 20 include two lower-half pipes 20*a* connected to the lower half of the inner casing 13 and two upper-half pipes 20*b* connected to the upper half of the inner casing 13.

The lower-half pipes 20*a* and the upper-half pipes 20*b* each have an outside pipe 21, a sleeve 22, a first sealing structure 23, and a second sealing structure 24.

The outside pipes 21 are connected to the outer surface of the outer casing 15 by welding to communicate with first discharge through holes 15*h* formed in the outer casing 15. The outside pipes 21 may be pipes routed around in the outside to be connected to the outer casing 15 or may be nozzle stub attached to the outer casing 15 and connected to pipes routed around up to the vicinity of the outer casing 15 from the outside.

The sleeves 22 are provided between the outer casing 15 and the inner casing 13 to communicate with the first discharge through holes 15*h* formed in the outer casing 15 and second discharge through holes 13*h* formed in the inner casing 13.

On the radially outer sides of the sleeves 22, the first sealing structures 23 and the second sealing structures 24, which are, for example, seal rings, are respectively disposed in the first discharge through holes 15*h* and the second discharge through holes 13*h* to keep sealability.

It should be noted that the structure of the outlet pipes 20 is not limited to the above structure. Another adoptable structure is that the outlet pipes 20 do not have the sleeves 22 and the outside pipes 21 penetrate through the outer casing 15 to communicate with the second discharge through holes 13*h* formed in the inner casing 13.

Further, the connection structure of the outlet pipes, the sleeves, or the like with the through holes formed in the outer casing 15 or the inner casing 13 may be of either what is called a set-on type in which they are connected on the outer sides of the through holes or a set-in type in which they are connected with the through holes while penetrating therethrough.

As illustrated in FIG. 2, the number of the outlet pipes 20 is four, out of which the two are the lower-half pipes 20*a* disposed in the lower half and the other two are the upper-half pipes 20*b* disposed in the upper half.

In the example illustrated in FIG. 2, the two lower-half pipes 20*a* are parallel to each other and the two upper-half pipes 20*b* are parallel to each other, but this is not restrictive. That is, the radial drawing directions of the outlet pipes 20 may be decided according to how the outlet pipes 20 or downstream pipes connected thereto are routed and arranged outside the gas turbine 10.

Further, in FIG. 2, the positions of discharge-chamber 14*a*-side ends of the outlet pipes 20 are set such that the two outlet pipes 20 in each of the lower half and the upper half are parallelly disposed on respective two sides of a vertical plane including the turbine axis C (FIG. 1), but this is not restrictive. For example, the positions of the exhaust chamber 14*a*-side ends of the four outlet pipes 20 may be disposed with circumferentially regular intervals therebetween.

Figure 3:
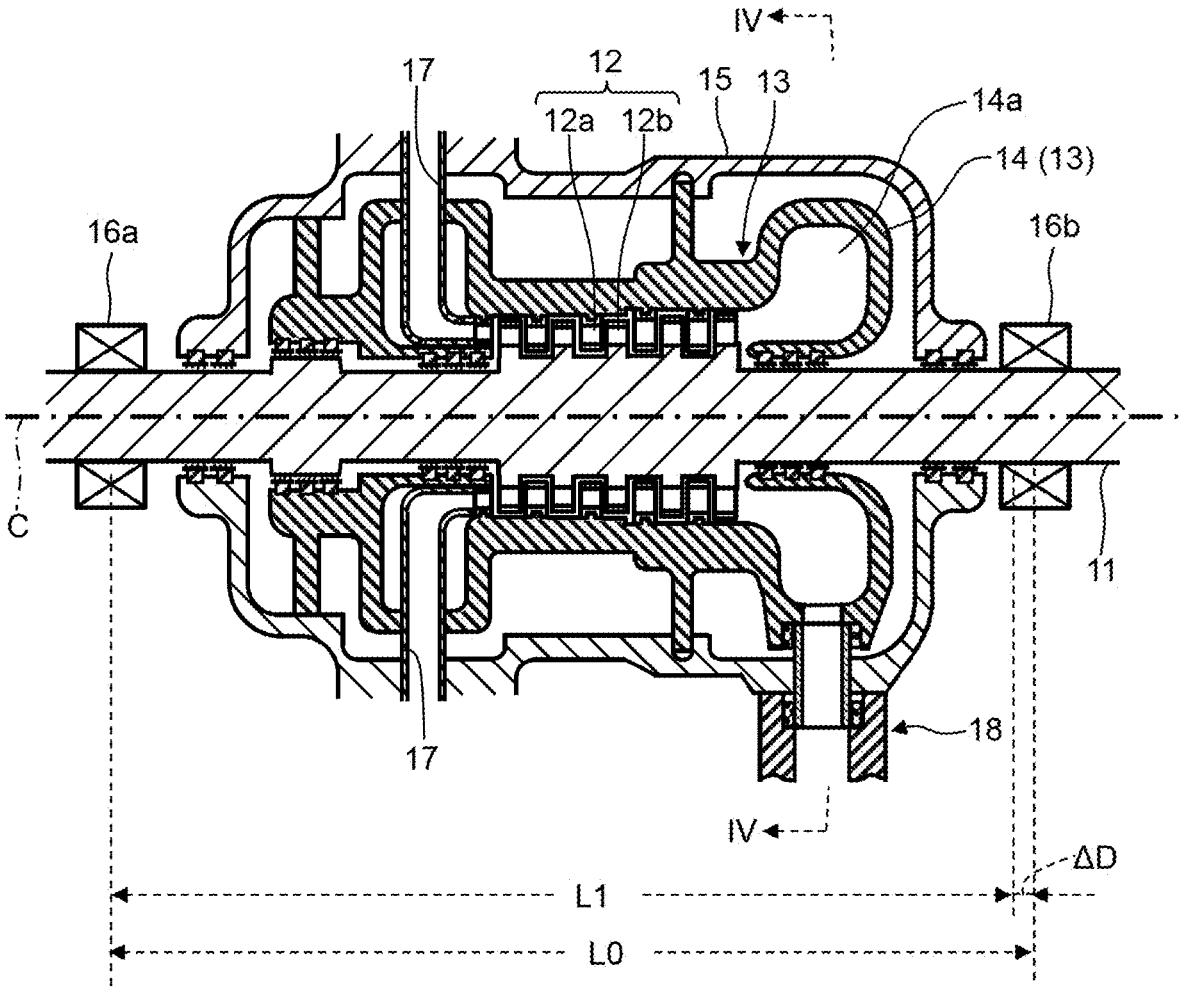
FIG. 3 is a sectional view illustrating an example of the configuration of a conventional gas turbine for explaining an effect of the gas turbine according to the first embodiment, taken along the turbine axis, taken along arrow III-III in FIG. 4.
Figure 4:
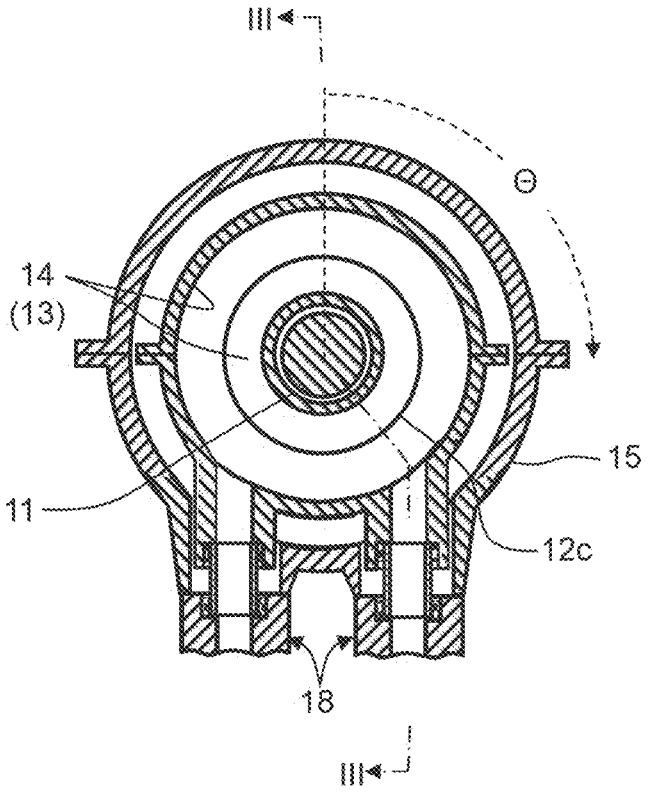
FIG. 4 is a sectional view illustrating an example of the configuration of a conventional gas turbine, taken along arrow IV-IV in FIG. 3.

FIG. 3 is a sectional view illustrating an example of the configuration of a conventional gas turbine for explaining an effect of the gas turbine according to the first embodiment, taken along the turbine axis C, and taken along arrow III-III in FIG. 4, and FIG. 4 is its sectional view taken along arrow IV-IV in FIG. 3.

The structure example of the conventional gas turbine is different in that two outlet pipes 18 are provided only in a lower half of an exhaust chamber wall 14 as illustrated in FIG. 4. Since the number of the outlet pipes 18 is two in the structure example of the conventional gas turbine, the outlet pipes 18 in the structure example of the conventional gas turbine are larger in outside diameter than the outlet pipes 20 in this embodiment in which the four outlet pipes 20 are provided.

Basically, to make a pressure loss in the outlet pipes 20 in this embodiment due to the flow of the exhaust gas equal to a pressure loss in the outlet pipes 18 in the conventional example, an average flow velocity of the exhaust gas in the outlet pipes 20 in this embodiment is made equal to that in the outlet pipes 18 in the conventional example, that is, the average flow velocity of the exhaust gas is maintained. If the average flow velocity of the exhaust gas is maintained, the outlet pipes 18 in the conventional example have a larger bore than the outlet pipes 20 in this embodiment.

This embodiment enables to make the axial length of the exhaust chamber wall 14 of the inner casing 13 shorter than that in the conventional example by ΔD, where ΔD is a difference between the outside diameter of the outlet pipes 18 in the conventional example and the outside diameter of the outlet pipes 20 in this embodiment.

As a result, the distance L1 between the front bearing 16*a* and the rear bearing 16*b* in this embodiment is shorter than the distance L0 between a front bearing 16*a* and a rear bearing 16*b* in the conventional example by at least ΔD.

Figure 5:
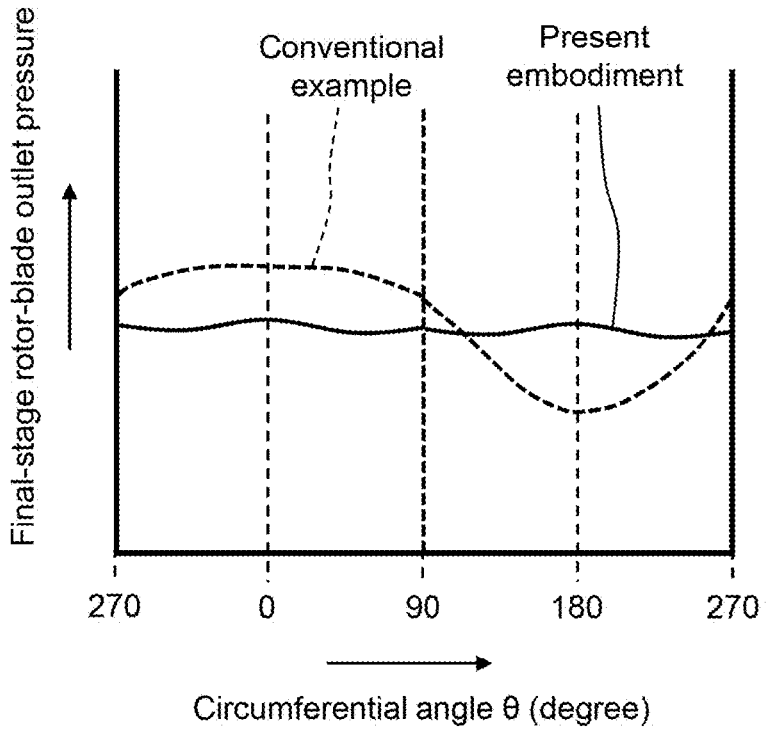
FIG. 5 is a comparison chart of circumferential-direction pressure distribution at a final-stage rotor-blade outlet between the gas turbine according to the first embodiment and the conventional gas turbine, for explaining an effect of the gas turbine according to the first embodiment.

FIG. 5 is a comparison chart of circumferential-direction pressure distribution at a final-stage rotor-blade outlet between the gas turbine according to the first embodiment and the conventional gas turbine, for explaining an effect of the gas turbine according to the first embodiment. The horizontal axis indicates a circumferential angle θ (degree) and the vertical axis indicates the final-stage rotor-blade outlet pressure.

Here, the circumferential angle θ (degree) is a clockwise angle from the middle of the upper half which is a zero degree point, when the final-stage rotor blade cascade 12*c* side is seen from the exhaust chamber 14*a* side as illustrated in FIG. 4.

In FIG. 5, the broken line indicates the circumferential distribution of the final-stage rotor-blade outlet pressure in the conventional example and the solid line indicates the circumferential distribution of the final-stage rotor-blade outlet pressure in the present embodiment.

In the conventional example, the exhaust gas flowing out from the rotor blades 12*b* of the final stage in the upper half flows in the exhaust chamber 14*a* until it reaches the outlet pipes 18 located in the lower half and thus undergoes a larger pressure loss than the flow of the exhaust gas flowing out from the rotor blades 12*b* of the final stage in the lower half. Since these flows are equal in pressure at inlets of the outside pipes 18, the pressure of the exhaust gas flowing out from the rotor blades 12*b* of the final stage in the upper half is higher by this pressure loss as illustrated in FIG. 5. Therefore, the final-stage rotor-blade outlet pressure in the upper half is high in a part around the zero-degree circumferential angle θ.

In this embodiment, on the other hand, providing the outlet pipes 20 also in the upper half eliminates a part where the final-stage rotor-blade outlet pressure becomes high as is present in the conventional example, to make the final-stage rotor-blade outlet pressure almost uniform in the circumferential direction. This improves turbine efficiency.

Figure 6:
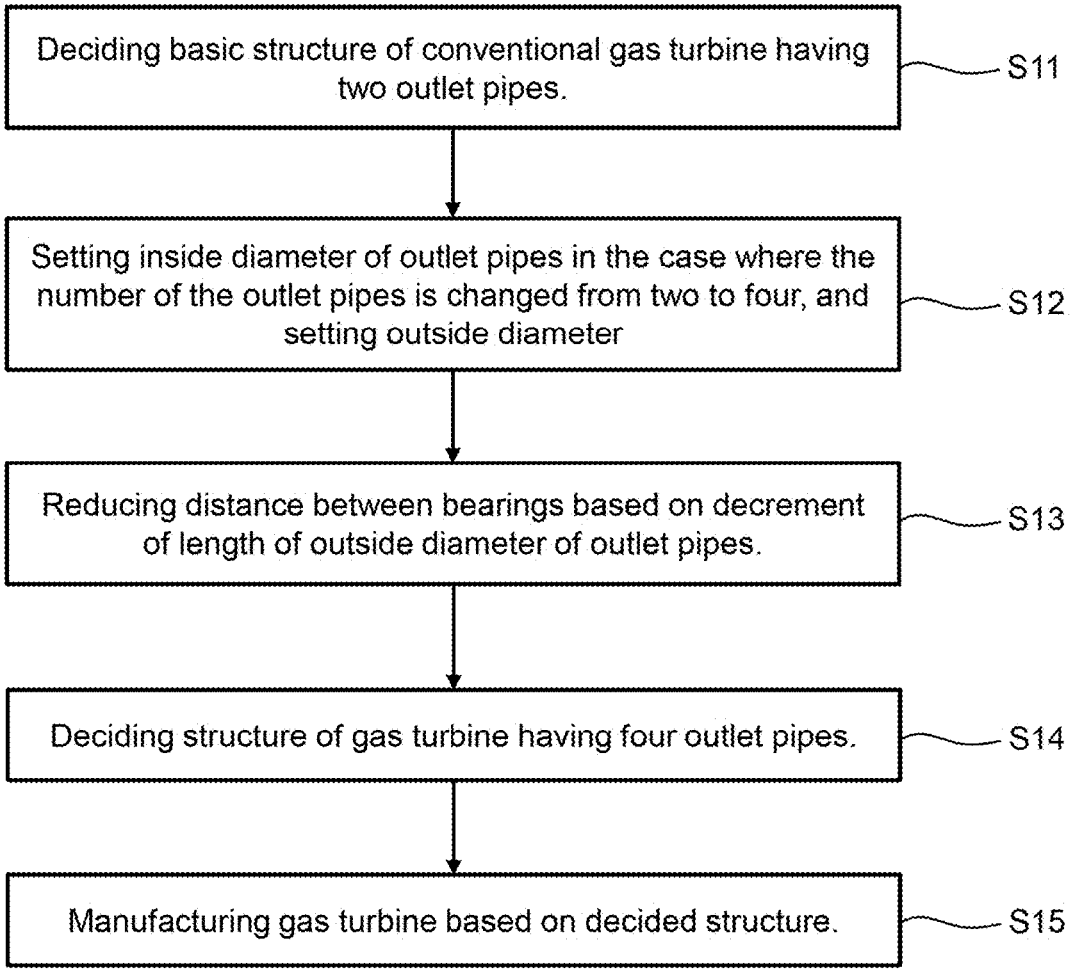
FIG. 6 is a flowchart illustrating a procedure of a method of manufacturing the gas turbine according to the first embodiment.

FIG. 6 is a flowchart illustrating a procedure of a method of manufacturing the gas turbine according to the first embodiment. The gas turbine manufacturing method in FIG. 6 describes a case in which the structure of the conventional gas turbine having the two outlet pipes is changed to the structure having the four outlet pipes.

First, the basic structure of the conventional gas turbine having the two outlet pipes is decided (Step S11).

Next, the inside diameter of the outlet pipes 20 in the case where the number of the outlet pipes is changed from two to four is set (Step S12). For example, the inside diameter of the outlet pipes 20 is set such that the average flow velocity of the exhaust gas in the outlet pipes 20 becomes equal to the average flow velocity of the exhaust gas in the two outlet pipes in the conventional example, that is, the average flow velocity of the exhaust gas is maintained. As for the thickness of the outlet pipes 20, a required thickness is set large enough to meet the pressure condition of the outlet pipes 20. Based on the inside diameter value and the required thickness of the outlet pipes thus calculated, a dimension not smaller than the calculated inside diameter value and enabling to keep the required thickness is selected. This dimension is set as the outside diameter of the outlet pipes 20. Further, based on this outside diameter, decrement of length of the outside diameter of the outlet pipes due to the change of the number of the outlet pipes from two to four is calculated.

Next, based on the decrement of length of the outside diameter of the outlet pipes, the distance between the bearings is reduced (Step S13). Specifically, based on the decrement of length of the outside diameter of the outlet pipes, the axial-direction lengths of the inner casing 13 and the outer casing 15 are set, and the positions of the front bearing 16*a* and the rear bearing 16*b* are set. This results in a reduction in the distance between the front bearing 16*a* and the rear bearing 16*b*.

Next, the structure of the gas turbine having the four outlet pipes is decided (Step S14). Based on the decided structure, the gas turbine is manufactured (Step S15).

As described above, this embodiment is capable of reducing the distance between the bearings by providing the outlet pipes in the upper half and the lower half along the entire circumference and maintaining the average flow velocity of the exhaust gas in the outlet pipes. By unifying the circumferential distribution of the final-stage rotor-blade outlet pressure by eliminating a part where the final-stage rotor-blade outlet pressure is high, this embodiment is further capable of improving the turbine efficiency.

Second Embodiment

A second embodiment is a modification of the first embodiment. The second embodiment is the same as the first embodiment in that the outlet pipes are provided also in the upper half of the exhaust chamber wall 14 to reduce the distance between the bearings, thereby reducing the whirl phenomenon as in the first embodiment, but is different from the first embodiment in that a turbine stage 12 is added.

Figure 7:
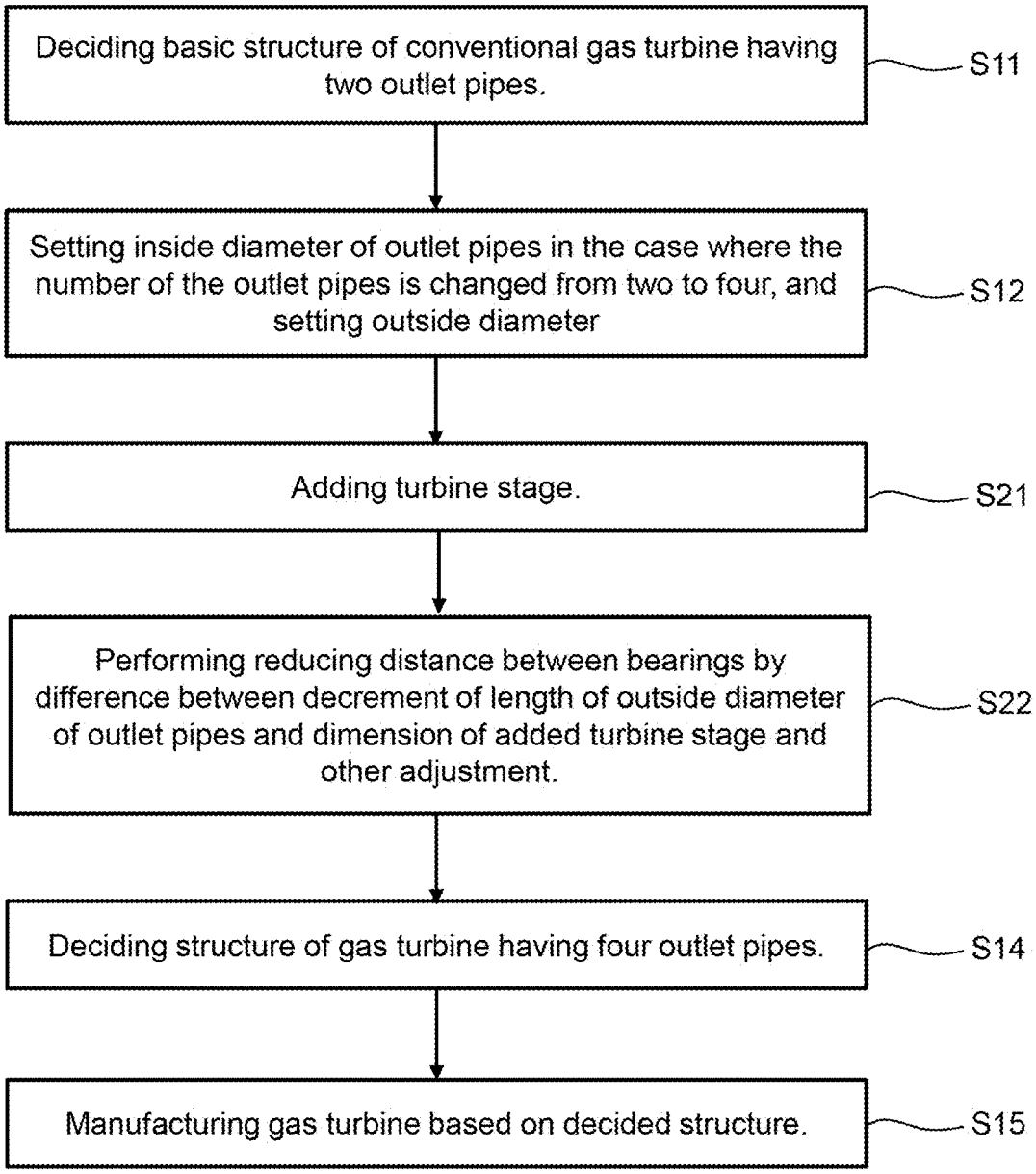
FIG. 7 is a flowchart illustrating a procedure of a method of manufacturing a gas turbine according to a second embodiment.

FIG. 7 is a flowchart illustrating a procedure of a method of manufacturing a gas turbine according to a second embodiment.

The procedure up to the sizing of the outlet pipes through Step S11 and Step S12 and the procedure of Step S14 and Step 15 where the structure of the gas turbine after the change is decided and the gas turbine is manufactured are the same as those of the first embodiment, but the procedure in the second embodiment is different in that Step 13 in the first embodiment is replaced with Step 21 and Step 22.

Subsequently to Step S12, the turbine stage 12 is added (Step S21). In addition, an axial-direction incremental dimension due to the addition of the turbine stage 12 is found. Where to add the turbine stage 12 is set such that the gas turbine 10 has the highest performance. Step S21 may be executed in parallel with Step S11 and Step S12.

Next, based on a difference between the decrement of length of the outside diameter of the outlet pipes and the dimension of the added turbine stage, and other adjustment results, step of reducing the distance between the bearings is performed (Step S22). That is, reducing the distance between the bearings by the difference of the subtraction of the dimension of the added turbine stage from the decrement of length of the outside diameter of the outlet pipes is performed.

Figure 8:
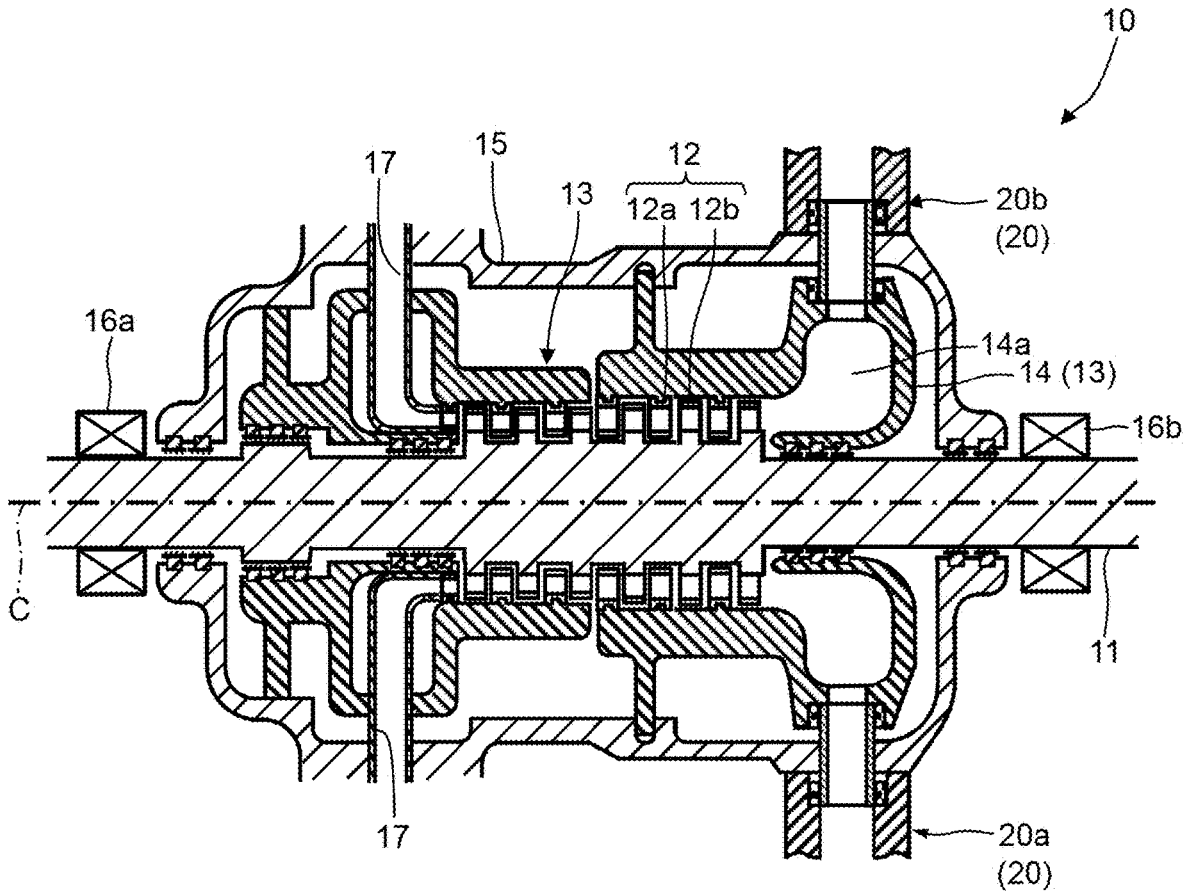
FIG. 8 is a sectional view illustrating the configuration of a gas turbine according to the second embodiment, taken along the turbine axis.

FIG. 8 is a sectional view illustrating the configuration of a gas turbine according to the second embodiment, taken along the turbine axis C. As illustrated in FIG. 8, the number of the turbine stages 12 is larger by one than that in the first embodiment illustrated in FIG. 1.

Figure 9:
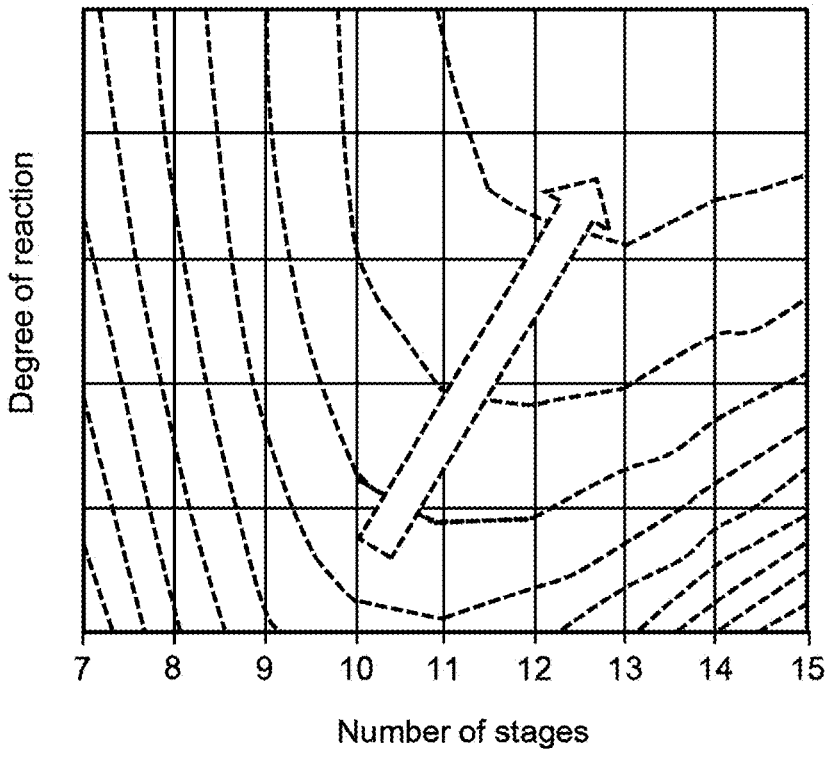
FIG. 9 is a graph illustrating the dependence of gas turbine efficiency on the number of stages and a degree of reaction, for explaining an effect of the gas turbine according to the second embodiment.

FIG. 9 is a graph illustrating the dependence of gas turbine efficiency on the number of stages and a degree of reaction, for explaining an effect of the gas turbine according to the second embodiment. FIG. 9 schematizes the chart given in Non-patent Document 1. The horizontal axis indicates the number of stages and the vertical axis indicates the degree of reaction. Further, the contour lines indicate the turbine efficiency, and the broken-line outline arrow indicates a direction in which the turbine efficiency increases.

As illustrated in FIG. 9, the turbine efficiency typically increases as the number of the stages increases.

This embodiment is capable of further increasing the turbine efficiency as well as reducing the distance between the bearings.

Third Embodiment

Figure 10:
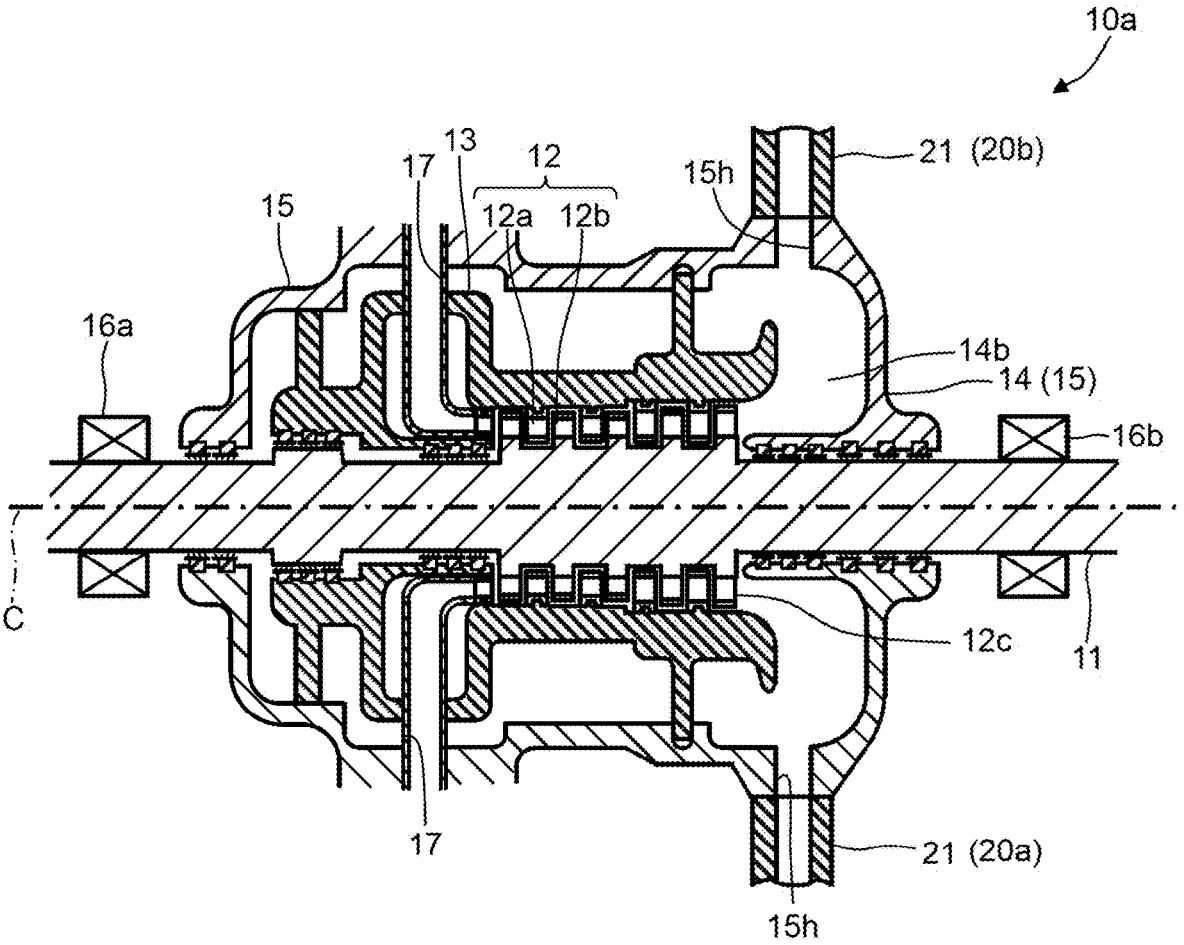
FIG. 10 is a sectional view illustrating the configuration of a gas turbine according to a third embodiment, taken along the turbine axis.

FIG. 10 is a sectional view illustrating the configuration of a gas turbine according to a third embodiment, taken along the turbine axis.

This embodiment is a modification of the first embodiment, and in the gas turbine 10*a*, a casing has an inner casing 13 and an outer casing 15 but has a single structure near an exhaust part. That is, near the exhaust part, the casing only has the outer casing 15, and an exhaust chamber wall 14 forming an exhaust chamber 14*b* is part of the outer casing 15.

In this embodiment, outlet pipes 20 only have outside pipes 21. The outside pipes 21 are attached to the outer side of the outer casing 15 by welding or the like to communicate with first discharge through holes 15*h* formed in the outer casing 15.

This embodiment is also capable of reducing the distance between bearings by adopting the structure having the four outlet pipes 20.

OTHER EMBODIMENTS

While certain embodiments have been described, these embodiments have been presented by way of example only, and are not intended to limit the scope of the inventions. That is, other forms or structures are applicable to the structure up to an exhaust port of the gas turbine.

Further, the novel embodiments described herein may be embodied in a variety of other forms; furthermore, various omissions, substitutions and changes in the form of the embodiments described herein may be made without departing from the spirit of the inventions.

The accompanying claims and their equivalents are intended to cover such forms or modifications as would fall within the scope and spirit of the inventions.

What is claimed is:

1. A gas turbine comprising:

a casing;

a rotor shaft penetrating through the casing;

a plurality of turbine stages which are disposed in the casing and are arranged along an axial direction of the rotor shaft and through which a working fluid passes;

two bearings disposed on axially both outer sides of the casing and supporting the rotor shaft in a rotatable manner; and a plurality of outlet pipes through which the working fluid having finished work in the turbine stages is discharged as exhaust gas, wherein the outlet pipes are provided in an upper half of the casing and a lower half of the casing, and wherein the outlet pipes in the upper half of the casing extend in a direction opposite to the outlet pipes in the lower-half of the casing.

2. The gas turbine according to claim 1, wherein the number of the outlet pipes is four, and two of the outlet pipes are disposed in the upper half of the casing and an other two of the outlet pipes are disposed in the lower half of the casing.

3. The gas turbine according to claim 1, wherein upstream ends of the outlet pipes are arranged with circumferentially regular intervals therebetween.

4. The gas turbine according to claim 1, wherein the casing has a single structure, and the working fluid in the casing is discharged toward outside of the casing through the outlet pipes.

5. The gas turbine according to claim 1, wherein the casing has an inner casing and an outer casing housing the inner casing, and the working fluid in the inner casing is discharged toward outside of the casing through the outlet pipes.

6. The gas turbine according to claim 1, wherein the casing has an inner casing and an outer casing housing the inner casing, and wherein the outlet pipes each have:

an outside pipe welded to an outer side of a through hole formed in the outer casing; and a sleeve through which a through hole formed in the inner casing and a through hole formed in the outer casing communicate with each other.

7. A gas turbine manufacturing method comprising:

providing a structure of a conventional gas turbine having two outlet pipes;

changing the number of the two outlet pipes provided in the conventional gas turbine to two in each of a lower half and an upper half of a casing and setting the two outlet pipes in each of the lower half and the upper half of the casing as outlet pipes of a new gas turbine;

maintaining an average flow velocity of exhaust gas in the outlet pipes at an average flow velocity of the exhaust gas in the outlet pipes of the conventional gas turbine to set an outside diameter of the outlet pipes of the new gas turbine;

calculating decrement of length of the outside diameter from an outside diameter of the outlet pipes of the conventional gas turbine; and reducing a distance between bearings based on the calculated decrement of length of the outside diameter, and wherein the outlet pipes in the upper half of the casing extend in a direction opposite to the outlet pipes in the lower-half of the casing.

8. The gas turbine manufacturing method according to claim 7, further comprising, before reducing the distance between bearings, adding a turbine stage and finding an axial-direction incremental dimension due to the addition of the turbine stage, wherein the reducing the distance between bearings reduces the distance between the bearings based on the calculated decrement of length of the outside diameter and the axial-direction incremental dimension found.

* * * * *